US007207419B2

(12) United States Patent
Fore et al.

(10) Patent No.: US 7,207,419 B2
(45) Date of Patent: Apr. 24, 2007

(54) SAFETY LOCK SYSTEM FOR A LIFT

(75) Inventors: Scott E. Fore, St. Charles, IL (US); Brian Beyer, Byron, IL (US)

(73) Assignee: Heftee Industries, LLC Ltd, Oregon, IL (US)

( * ) Notice: Subject to any disclaimer, the term of this patent is extended or adjusted under 35 U.S.C. 154(b) by 0 days.

(21) Appl. No.: 11/052,186

(22) Filed: Feb. 7, 2005

(65) Prior Publication Data

US 2006/0175133 A1 Aug. 10, 2006

(51) Int. Cl.
*B66F 7/00* (2006.01)
*B66F 7/10* (2006.01)
*B66B 5/12* (2006.01)

(52) U.S. Cl. ..... 187/208; 187/203; 187/207; 187/363

(58) Field of Classification Search ..... 187/203, 187/207, 208, 222, 363
See application file for complete search history.

(56) References Cited

U.S. PATENT DOCUMENTS 3,402,828 A * 9/1968 Vilter ..... 414/678
3,582,043 A 6/1971 Tranchero
3,836,014 A * 9/1974 Johansson ..... 414/678
3,934,680 A * 1/1976 Bishop ..... 187/206
4,076,104 A * 2/1978 Bishop et al. ..... 187/206
4,241,901 A 12/1980 Shircliffe
4,331,219 A * 5/1982 Suzuki ..... 187/207
4,506,866 A * 3/1985 Horn ..... 254/2 B
4,531,614 A 7/1985 Naegeli
4,856,618 A * 8/1989 Isogai ..... 187/208
4,976,336 A * 12/1990 Curran ..... 187/208
5,211,264 A 5/1993 Beattie et al.
5,339,926 A * 8/1994 McCanse et al. ..... 187/204
5,358,217 A * 10/1994 Dach ..... 254/2 R
5,632,475 A 5/1997 McCanse
5,711,512 A 1/1998 Kauffman
6,116,577 A * 9/2000 McCanse ..... 254/2 B
6,382,358 B1 5/2002 Kritzer
6,685,038 B1 2/2004 Johnston et al.

* cited by examiner

*Primary Examiner*—Eileen D. Lillis
*Assistant Examiner*—Eric E. Pico
(74) *Attorney, Agent, or Firm*—Vedder Price Kaufman & Kammholz

(57) ABSTRACT

A lift having a safety lock system includes a mast that may be supported by a base, and a frame that can be lifted or lowered along the mast. The safety lock system includes a first support beam that is located adjacent to the mast and a second support beam that is located opposite the first support beam relative to the mast. The safety lock system also includes a first lock and a second lock. Each of the first lock and the second lock are operable between a plurality of locked positions and an unlocked position. In the locked position, the first lock is engaged with the first support beam to lock the lift frame to the first support beam, and the second lock is engaged with the second support beam to lock the lift frame to the second support beam. Each of the first lock and the second lock can be placed in the unlocked position, wherein the lift frame can be freely lifted or lowered relative to the mast. The safety lock system also includes a lock control mechanism that is operatively coupled to the first lock and the second lock to simultaneously operate the first lock and the second lock between the plurality of locked positions and the unlocked position.

25 Claims, 3 Drawing Sheets

SAFETY LOCK SYSTEM FOR A LIFT

FIELD OF THE DISCLOSURE

The present application relates to lifts, and more particularly, to a safety lock system for a lift.

BACKGROUND

Lifts are typically used to elevate heavy machinery or equipment to provide access to the bottom portions of such equipment or machinery. Such access may be necessary for repair or maintenance of such machinery or equipment. For example, lifts are typically used to elevate vehicles so that a mechanic servicing the vehicle can walk underneath the vehicle to work on the vehicle.

Lifts include a frame that moves vertically along one or multiple masts. The frame may include a pair of arms that extend outward. The arms are spaced apart so that a vehicle can be supported on the arms when the vehicle is lifted by the frame. The lift may include one or more masts that support the frame and the load of the vehicle being lifted by the frame. The mast(s) may be installed in the ground or be supported by a base.

Lifts typically operate by hydraulic power. Accordingly, hydraulic fluid is pressurized by one or a number of hydraulic pumps. The pressurized fluid then powers hydraulic actuators that can lift the vehicle with the frame. To maintain a vehicle in the elevated position, however, lifts have various locking systems to lock the frame to the mast or any other stationary structure of the lift. By locking the frame, the hydraulic actuator can only be used to lift the frame and does not have to operate to maintain the frame at a desired height. Additionally, the locking systems provide a safety feature in that to lower the frame, the locking system has to be unlocked.

Lifts typically include a locking system that can lock the frame to safely maintain the frame at a desired height. These locking systems may include several locks that have to be individually locked and unlocked by the operator of the lift. Each lock may have a unique vertical position along the mast that corresponds with a desired locking position. For example, a lift can include five locks that are positioned vertically along the mast such that each lock is spaced from an adjacent lock by a foot. Accordingly, the frame can be locked at five different heights relative to the mast, with each height being a foot apart from another lock. Accordingly, the number of locking positions of the frame and the distance between each locking position is defined by the number of locks and the distance between each lock, respectively. Additionally, in such lifts only one lock may be provided for each desired height. Therefore, in case of lock failure, the lift may drop and cause injury or death to any operator who may be standing near or beneath the lift.

Therefore, there exist a need for a locking system for lifts that provides safety in case of lock failure, a large number of close height adjustment increments for the locking of the frame, and ease of operation for the operator of the lift.

SUMMARY

In accordance with one principal aspect of the present disclosure, a lock system for a single mast lift having a lift frame comprises a first support beam disposed adjacent to a first side of the mast, a second support beam disposed adjacent to a second side of the mast, a first lock and a second lock. The first lock is attached to the lift frame and is operable between a plurality of locked positions wherein the first lock is engaged with the first support beam to lock the lift frame to the first support beam and an unlocked position wherein the first lock is disengaged from the first support beam to unlock the lift frame from the first support beam. The second lock is attached to the lift frame and is operable between the plurality of locked positions wherein the second lock is engaged with the second support beam to lock the lift frame to the second support beam and the unlocked position wherein the second lock is disengaged from the second support beam to unlock the lift frame from the second support beam. The lock system further includes a lock control mechanism operatively coupled to the first lock and the second lock to simultaneously operated the first lock and the second lock between the plurality of locked positions and the unlocked position.

In accordance with another principal aspect of the present disclosure, a lift includes a mast, a lift frame operatively coupled to the mast, the lift frame being moveable along a length of the mast between a plurality of locked positions and an unlocked position, a first support beam disposed adjacent to a first side of the mast, a second support beam disposed adjacent to a second side of the mast, a first lock, and a second lock. The first lock is attached to the lift frame and is substantially aligned with the first support beam. The first lock is configured to engage the first support beam in any one of the plurality of locked positions and to disengage from the first support beam in the unlocked position. The second lock is attached to the lift frame and is substantially aligned with the second support beam, the second lock configured to engage the second support beam in any one of the plurality of locked positions and to disengage from the second support beam in the unlocked positions. The lift further includes a lock control mechanism operatively coupled to the first lock and the second lock to simultaneously operate the first lock and the second lock between any of the plurality of locked positions and the unlocked position.

In accordance with another principal aspect of the present disclosure, a lock system for a lift having a single mast and a lift frame includes a first support beam disposed adjacent to a first side of the mast, the first support beam including a plurality of longitudinally disposed first apertures, a second support beam disposed adjacent to a second side of the mast, the second support beam including a plurality of longitudinally disposed second apertures, each second aperture being laterally aligned with a corresponding first aperture, a first lock and a second lock. The first lock is attached to the lift frame and includes a first lock projection configured to engage any one of the first apertures of the first support beam. The second lock is attached to the lift frame and includes a second lock projection configured to engage the second aperture corresponding to the first aperture being engaged by the first lock projection. The first lock projection and the second lock projection are simultaneously operable between one of a plurality of locked positions engaging any one of the first apertures and a corresponding second aperture, respectively, to lock the frame to the first support beam and the second support beam, and an unlocked position to disengage from the engaged first aperture and the corresponding second aperture, respectively, to unlock the frame from the first support beam and the second support beam. The lock system further includes a lock control mechanism operatively coupled to the first lock and the second lock to simultaneously operate the first lock and the second lock between any of the plurality of locked positions of the frame and the unlocked position of the frame.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION

Figure 1:
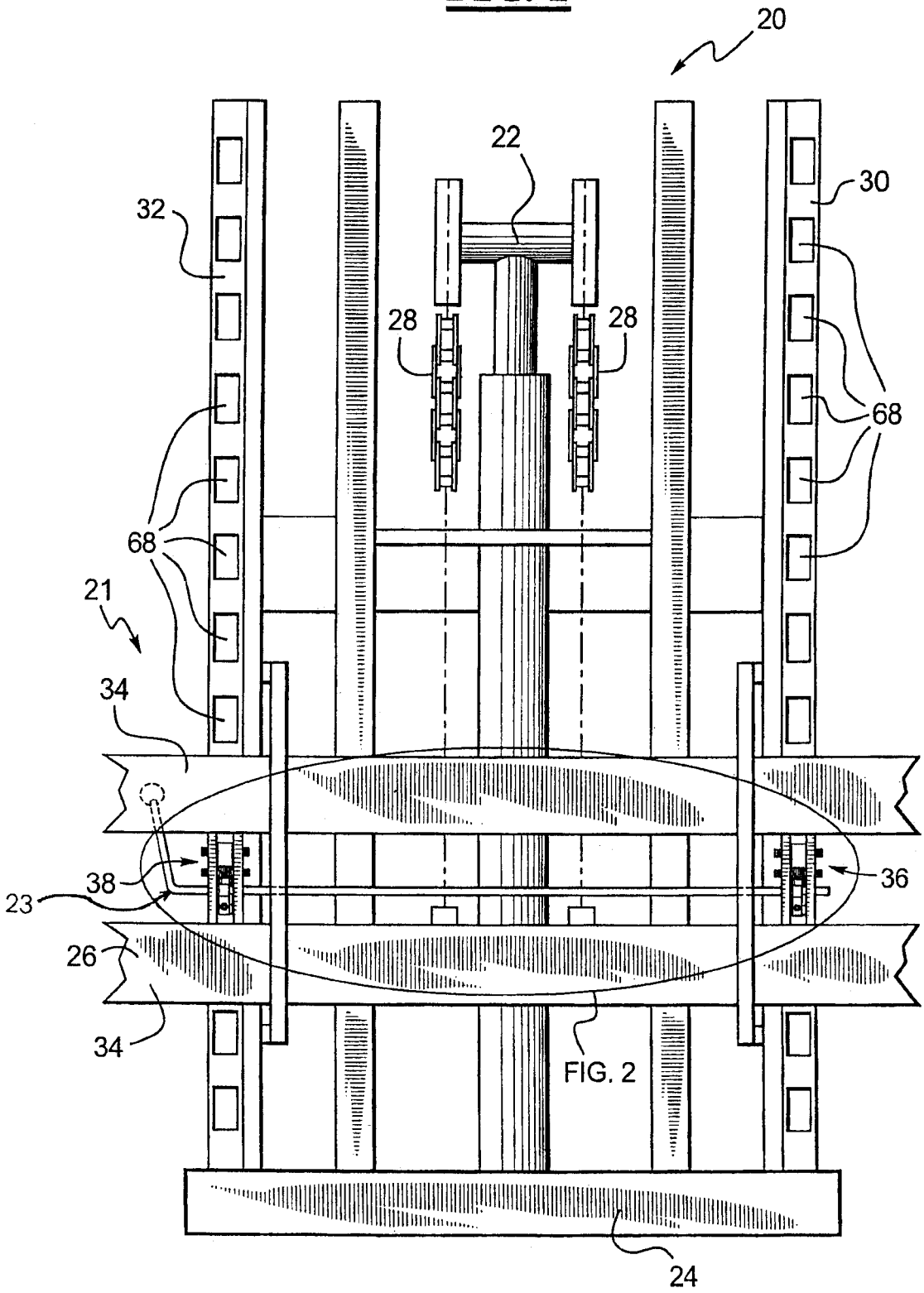
FIG. 1 illustrates a front view of a lift having a safety lock system constructed in accordance with the teachings of the present disclosure.

For the purposes of promoting and understanding the principles disclosed herein, reference will now be made to the preferred embodiments illustrated in the drawings and specific language will be used to describe the same. It will nevertheless be understood that no limitation of the scope is thereby intended. Such alterations and further modifications in the illustrated device and such further applications are the principles disclosed as illustrated therein as being contemplated as would normally occur to one skilled in the art to which this disclosure relates.

Referring to FIG. 1, a lift 20 having a safety lock system 21 constructed in accordance with the teachings of the present disclosure is generally shown. The lift 20 includes a mast 22 that may be supported by a base 24, and a frame 26 that can be lifted or lowered along the mast 22. The safety lock system 21 includes a first support beam 30 that is located adjacent to the mast 22 and a second support beam 32 that is located opposite the first support beam 30 relative to the mast 22. The safety lock system 21 also includes a first lock 36 a second lock 38. Each of the first lock 36 and the second lock 38 is operable between a plurality of locked positions and an unlocked position. In the locked position, the first lock 36 is engaged with the first support beam 30 to lock the lift frame 26 to the first support beam 30, and the second lock 38 is engaged with the second support beam 32 to lock the lift frame 26 to the second support beam 32. Each of the first lock 36 and the second lock 38 can be placed in the unlocked position, wherein the lift frame 26 can be freely lifted or lowered relative to the mast 22. The safety lock system 21 also includes a lock control mechanism 23 that is operatively coupled to the first lock 36 and the second lock 38 to simultaneously operate the first lock 36 and the second lock 38 between the plurality of locked positions and the unlocked position.

The mast 22 may be vertically oriented and may be supported by a base 24. The lift 20 may include a lift actuation system (not shown) that operates a chain 28, which is connected to the frame 26. The lift actuation system pulls or releases the chain 28, which lifts or lowers the frame 26, respectively. The first support beam 30 and the second support beam 32 may be generally parallel with the mast 22 and supported by the mast 22 and/or the base 24. The frame 26 includes a pair of frame tubes 34, between which the first lock 36 and the second lock 38 are disposed. The first lock 36 and the second lock 38 may be attached to the frame tubes 34. The first lock 36 is generally aligned with the first support beam 30, and the second lock 38 is generally aligned with the second support beam 32. When the frame 26 is lifted along the mast 22, the first lock 36 and the second lock 38 can simultaneously engage the first support beam 30 and the second support beam 38, respectively, at one of a plurality of locked positions to lock the frame 26 to the first support beam 30 and the second support beam 32, respectively.

In the disclosed examples, the first lock 36 and the second lock 38 are similar in structure and operation. Accordingly, the first lock 36 and the second lock 38 include similar components that operate in a similar manner. Therefore, the structure and operation of the first lock 36 and/or the second lock 38 may be described herein, with the understanding that the description is equally applicable to both the first lock 36 and the second lock 38. However, one of ordinary skill in the art will readily appreciate that the first lock 36 and the second lock 38 may be similar in only a few respects or completely different without departing from the scope of the present disclosure.

Figure 2:
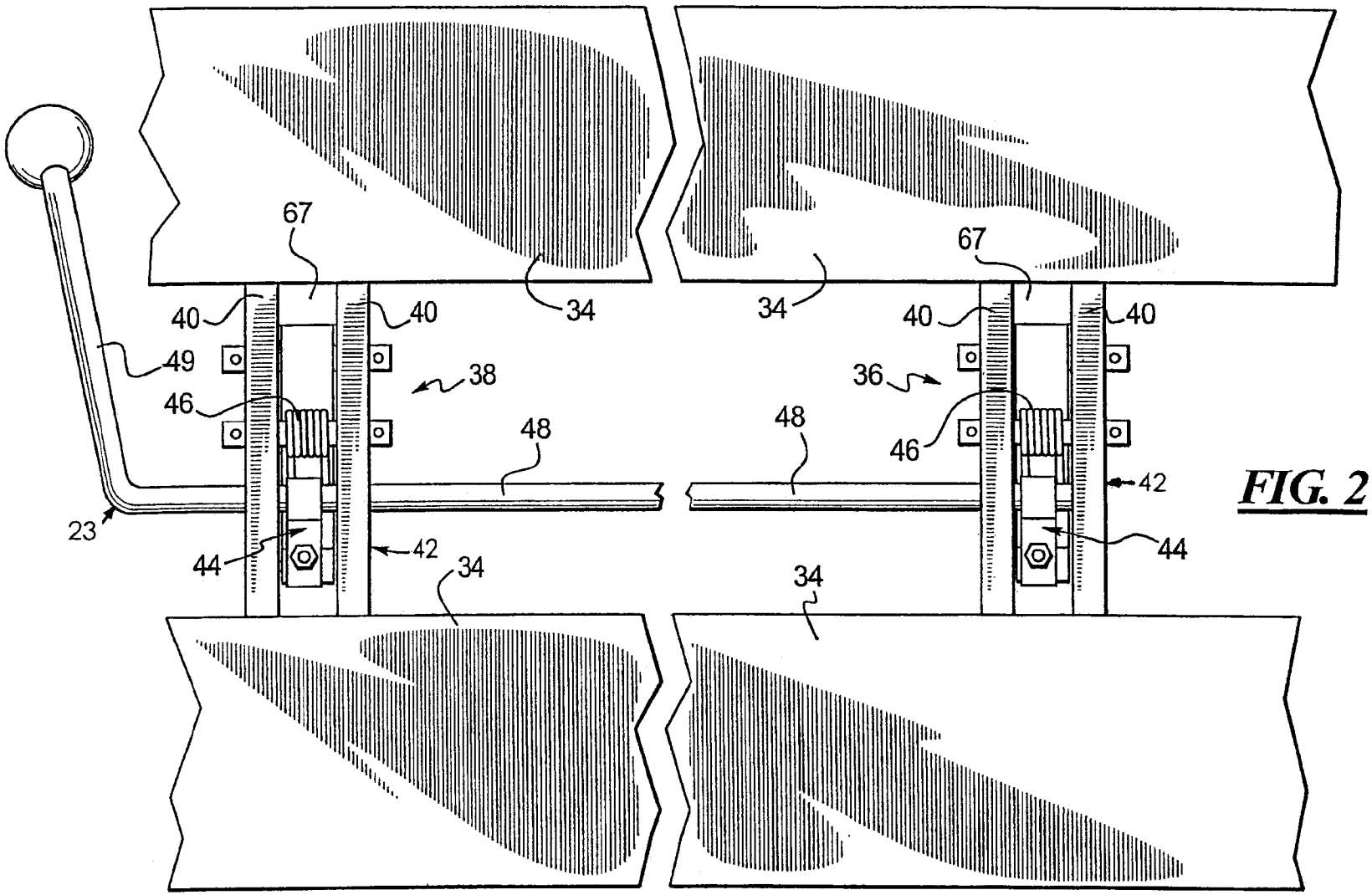
FIG. 2 illustrates a fragmentary view of the region 2 of FIG. 1.

Referring to FIG. 2, each of the first lock 36 and the second lock 38 includes a pair of support plates 40 that are spaced apart to define a lock housing 42. Each support plate 40 may be attached to the pair of frame tubes 34. The lock housing 42 houses a pivot assembly 44 that generally operates the corresponding first lock 36 or the second lock 38. A spring 46 is pivotally disposed in the lock housing 42 to bias a corresponding first lock 36 or the second lock 38 to the locked position. A lock release bar 48 is connected to the pivot assemblies 44 of the first lock 36 and the second lock 38. Accordingly, as will be described in detail in the following, rotation of the lock release bar 48 can simultaneously operate the first lock 36 and the second lock 38 between any one of the plurality of locked positions and the unlocked position. A lever 49, which may be an extension of the lock release bar 48 allows an operator to rotate the lock release bar 48.

Figure 4:
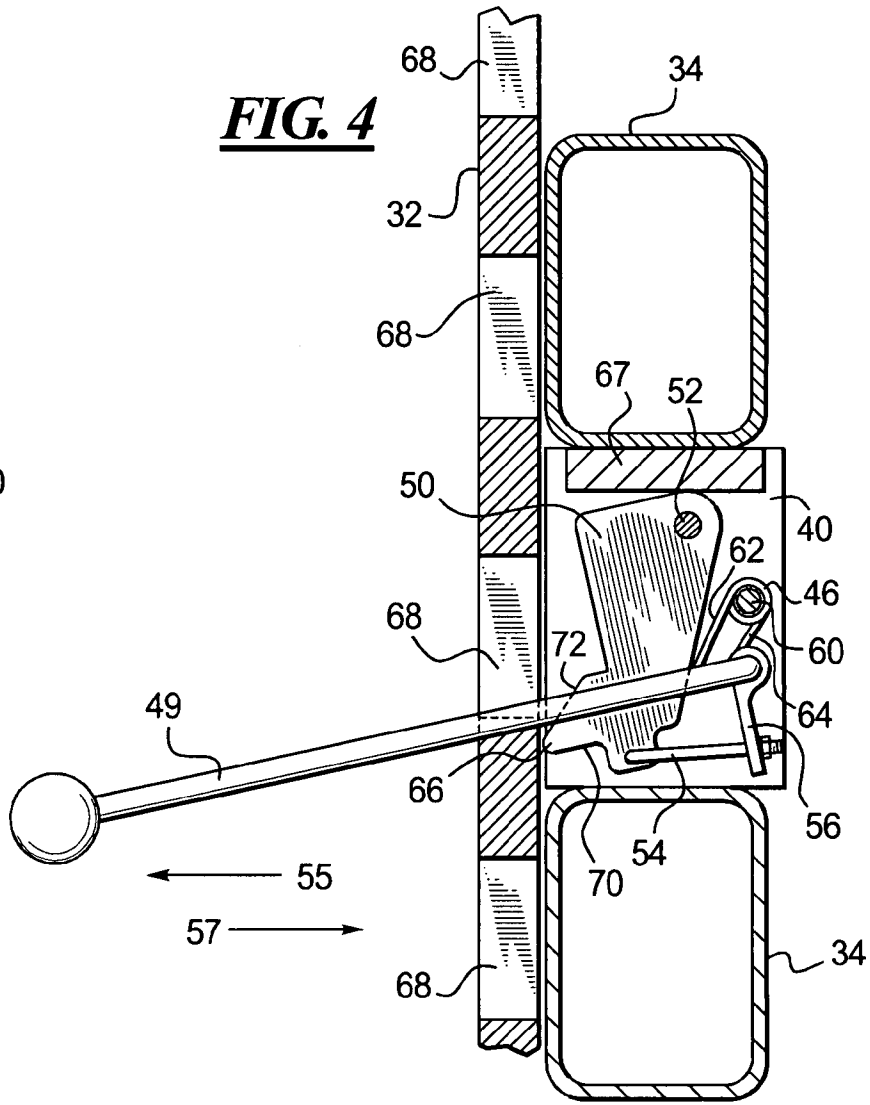
FIG. 4 is a side view of the safety lock of FIG. 3 illustrated in the unlocked position.
Figure 3:
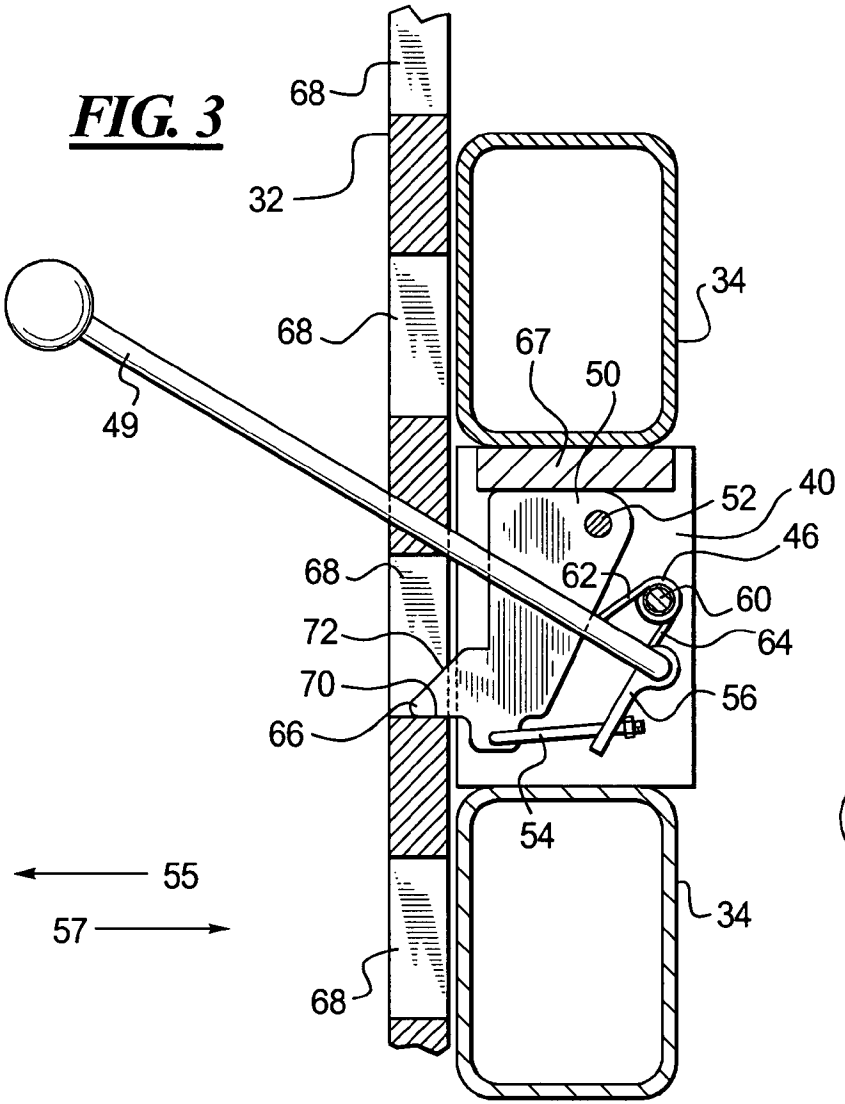
FIG. 3 is a side view of a safety lock constructed in accordance with the teachings of the present disclosure illustrated in the locked position.

Referring to FIGS. 3 and 4, a side view of the second lock 38 is shown with a support plate 40 removed to illustrate and describe the components and the operation of the first lock 36 and the second lock 38. The second lock 38 includes lock lug 50 that is generally parallel to the support plates 40 and pivots relative to the support plates 40 about a support pin 52. The pivot assembly 44 is connected to the lock lug 50 and includes a pivot arm 54 and a cam 56. The cam 56 can slide along the pivot arm 54 in a locking direction as represented by the arrow 55, and an unlocking direction as represented by the arrow 57. The cam 56 can freely slide along the pivot arm 54 in the locking direction 55. However, an adjustment screw 58 prevents the cam 56 from sliding along the pivot arm 54 in the unlocking direction 57. The cam 56 is connected to the lock release bar 48 and rotates with the lock release bar 48. The spring 46 is pivotally mounted in the lock housing 42 on a spring pivot pin 60. The spring 46 includes a first end 62 that is in contact with the lock lug 50 and a second end 64 that is connected to the cam 56.

The lock lug 50 includes a projection 66. The lock lug 50 pivots about the lug support pin 52. Accordingly, the pivoting of the lock lug 50 moves the projection 66 in the locked direction 55 and the unlocked direction 57. To prevent over pivoting of the lock lug 50 about the pin 52, the second lock 38 includes a lock lug stop 67 that is attached to one or both of the plates 40 above the lock lug 50. As shown in FIGS. 3 and 4, the first support beam 30 and the second support beam 32 include a plurality of apertures 68 that are disposed along the length of the support beam 32. Although only the second support beam 32 is shown in FIGS. 3 and 4, the first support beam 30 and the second support beam 32 may be substantially similar as shown in FIG. 1. Each aperture 68 is sized, shaped, arranged and positioned to receive the projection 66. When the projection 66 engages an aperture 68, any movement of the second lock 38, and consequently, the frame tubes 34 along the mast 22 or the second support beam 32 is prevented. Therefore, when the projection 66 engages any one of the apertures 68, the frame 26 is locked along the mast 22 at a height that corresponds to the vertical position of the aperture 68 on the second support beam 32. The apertures 68 may be spaced apart by any distance to provide a plurality of desired locking position increments along the second support beam 32.

The lock lug 50 can pivot about the pivot pin 52, which causes the projection 66 to move in the locked direction 55 or the unlocked direction 57. Because the first end 62 of the spring 46 is in contact with the lock lug 50, the rotation of the lock lug 50 toward the spring 46 will compress the spring 46. Accordingly, the spring 46 will force the lock lug 50 in the opposite direction. Therefore, the lock lug 50 is biased in the locked direction 55 by the spring 46. The bias of the lock lug 50 in the locked direction 55 can cause the projection 66 to engage an aperture 68 of the second support beam 32 if the projection 66 and the aperture 68 are nearly aligned. If the projection 66 is not nearly aligned with an aperture 68, any lift or lowering of the frame 26 will cause the projection 66 to align with an adjacent aperture 68. The bias of the lock lug 50 toward the locked direction 55 will then cause the projection 66 to engage that aperture 68 to lock the frame 26 to the second support beam 32.

The projection 66 includes a flat bottom surface 70 and an inclined upper surface 72. The bottom surface 70 can engage any one of the apertures 68 to prevent the frame 26 from being lowered. However, if the frame 26 is lifted or raised, the inclined upper surface 72 slidably contacts the aperture 68 to force the lock lug 50 to move in the unlocked direction 57 against the force of the spring 46. The movement of the lock lug 50 in the unlocked direction 57 causes the pivot arm 54 to slide relative to the cam 56. Accordingly, lifting of the frame 26 causes the projection 66 to disengage from the aperture 68. Additional lifting of the frame 26 will cause the projection 66 to engage an adjacent aperture 68 and to be disengaged again if the frame 26 is continued to be lifted. Therefore, in the locked position, the first lock 36 and the second lock 38 allow the frame 26 to be lifted to engage any one of the apertures 68 desired. However, once the first lock 36 and the second lock 38 engage any one of the apertures 68 of the first support beam 30 and the second support beam 32, respectively, the frame 26 is prevented from being lowered along the mast 22.

To lower the frame 26, an operator of the lift 20 can pull the lever 49 downward as shown in FIG. 3. The downward motion of the lever 49 rotates the lock release bar 48, which causes the cam 56 to pivot in the unlocked direction 57. Because the adjustment screw 58 prevents the cam 56 from sliding in the unlocked direction 57, the pivoting of the cam 56 causes the pivot arm 54 to also be pulled in the unlocked direction 57, which in turn causes the lock lug 50 to pivot about the lug support pin 52. Accordingly, the projection 66 moves in the unlocked direction 57 and disengages the aperture 68. Therefore, the downward motion of the lever 49 disengages both the first lock 36 and the second lock 38 from the first and second support beams 30 and 32, respectively. In the unlocked position, the frame 26 can be lowered along the mast 22 to a desired height. To lower the frame 26, however, the downward pull on the lever 49 must be maintained, because if the lever 49 is released, the bias in the spring 46 will cause the projection 66 to move in the locked direction 57 to engage an aperture 68 and consequently lock the frame 26 to the first support beam 30 and the second support beam 32.

The first lock 36 and the second lock 38 of the present disclosure in cooperation with the first support beam 30 and the second support beam 32, respectively, provide a dual lock system for the lift 20. Accordingly, when the frame 26 is in the locked position, the load of the frame 26 that is carried by the first lock 36 and the second lock 38 is symmetrically distributed to the first support beam 30 and the second support beam 32, respectively, which then distribute the load to the mast 22 and/or the base 24. Each of the first lock 36 and the second lock 38 is alone capable of maintaining the frame 26 in the locked position. Accordingly, if one of the locks 36 or 38 fails to lock or fails to function, the other lock can provide the locking function described in the foregoing. The lock release arm 48 provides simultaneous operation of the first lock 36 and the second lock 38. Accordingly, an operator does not have to disengage the locks 36 and 38 individually to lower or lift the frame 26. Additionally, the apertures 68 of the first support beam 30 and the second support beam 32 can be sized and spaced as desired to provide desired vertical locking increments of the frame 26 along the mast. For example, the apertures can be apart 3.75 inches. Therefore, the frame 26 can be locked along the mast 22 at vertical increments of 3.75 inches.

Although the structure and function of locks 36 and 38 have been described in detail herein, one of ordinary skill in the art will readily appreciate that any suitable structure for the locks 36 and 38 can be used to provide the above described functions of locking the frame 26 and unlocking the frame 26. For example, the lock release bar 48 can be coupled to a plurality of motor driven gears that provide motorized operation of the locks 36 and 38. In another example, the spring 46 may be a helical spring that is disposed between the lock lug 50 and the cam 56 to provide the same function as described herein. In yet another example, the pivot arm 54 and the cam 56 can be telescopic tubes that slide relative to each other to provide the same function as described herein.

Furthermore, while the particular preferred embodiments have been shown and described, it will be obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A lock system for a lift having a single extendable mast, the lock system comprising:

a first stationary support beam disposed adjacent to a first side of the mast;

a second stationary support beam disposed adjacent to a second side of the mast;

a lift frame connected to the extendable mast such that the lift frame is movable with respect to the first and second stationary support beams;

a first lock attached to the movable lift frame and operable between a plurality of locked positions wherein the first lock is engaged with the first stationary support beam to lock the movable lift frame to the first stationary support beam and an unlocked position wherein the first lock is disengaged from the first stationary support beam to unlock the movable lift frame from the first stationary support beam;

a second lock attached to the movable lift frame and operable between the plurality of locked positions wherein the second lock is engaged with the second stationary support beam to lock the movable lift frame to the second stationary support beam and the unlocked position wherein the second lock is disengaged from the second stationary support beam to unlock the movable lift frame from the second stationary support beam; and a lock control mechanism operatively coupled to the first lock and the second lock to simultaneously operate the first lock and the second lock between the plurality of locked positions and the unlocked position.

2. The lock system of claim 1, the first lock comprising:

a pair of substantially parallel support plates attached to the frame and being spaced apart to define a lock housing;

a lock lug pivotally disposed in the lock housing to engage the first support beam in the locked position and to disengage from the first support beam in the unlocked position, the lock lug including a lock projection configured to engage the first support beam; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

3. The lock system of claim 2, the lock control mechanism comprising a lock release bar operatively coupled to the lock lug pivot assembly, the lock release bar including a lever to pivot the lock lug pivot assembly, wherein the lock release bar is operatively coupled to the second lock.

4. The lock system of claim 2, the first support beam comprising a plurality of longitudinally disposed apertures configured to be engagable by the lock projection to lock the lift frame to the first support beam.

5. The lock system of claim 2, the first lock including a lock lug stop disposed in the lock housing to limit the pivoting of the lock lug.

6. The lock system of claim 1, the second lock comprising:

a pair of substantially parallel support plates attached to the frame and being spaced apart to define a lock housing;

a lock lug pivotally disposed in the lock housing to engage the second support beam in the locked position and to disengage from the second support beam in the unlocked position, the lock lug including a lock projection configured to engage the second support beam; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

7. The lock system of claim 6, the lock control mechanism comprising a lock release bar operatively coupled to the lock lug pivot assembly, the lock release bar including a lever to pivot the lock lug pivot assembly, wherein the lock release bar is operatively coupled to the first lock.

8. The lock system of claim 6, the second support beam comprising a plurality of longitudinally disposed apertures configured to be engagable by the lock projection to lock the lift frame to the second support beam.

9. The lock system of claim 6, the second lock including a lock lug stop disposed in the lock housing to limit the pivoting of the lock lug.

10. A lift comprising:

an extendable mast;

a first stationary support beam disposed adjacent to a first side of the mast;

a second stationary support beam disposed adjacent to a second side of the mast;

a lift frame connected to the extendable mast such that the lift frame is movable with respect to the first and second stationary support beams;

a first lock attached to the movable lift frame and substantially aligned with the first stationary support beam, the first lock configured to engage the first stationary support beam in any one of the plurality of locked positions and disengage from the first stationary support beam in the unlocked position;

a second lock attached to the movable lift frame and substantially aligned with the second stationary support beam, the second lock configured to engage the second stationary support beam in any one of the plurality of locked positions and disengage from the second stationary support beam in the unlocked positions; and a lock control mechanism operatively coupled to the first lock and the second lock to simultaneously operate the first lock and the second lock between any of the plurality of locked positions and the unlocked position.

11. The lift of claim 10, the first lock comprising:

a pair of substantially parallel support plates attached to the frame and being spaced apart to define a lock housing;

a lock lug pivotally disposed in the lock housing to engage the first support beam in the locked position and to disengage from the first support beam in the unlocked position, the lock lug including a lock projection configured to engage the first support beam; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

12. The lift of claim 11, the lock control mechanism comprising a lock release bar operatively coupled to the lock lug pivot assembly, the lock release bar including a lever to pivot the lock lug pivot assembly, wherein the lock release bar is operatively coupled to the second lock.

13. The lift of claim 11, the first support beam comprising a plurality of longitudinally disposed apertures configured to be engagable by the lock projection to lock the lift frame to the first support beam.

14. The lift of claim 11, the first lock including a lock lug stop disposed in the lock housing to limit the pivoting of the lock lug.

15. The lift of claim 10, the second lock comprising:

a pair of substantially parallel support plates attached to the frame and being spaced apart to define a lock housing;

a lock lug pivotally disposed in the lock housing to engage the second support beam in the locked position and to disengage from the second support beam in the unlocked position, the lock lug including a lock projection configured to engage the second support beam; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

16. The lift of claim 15, the lock control mechanism comprising a lock release bar operatively coupled to the lock lug pivot assembly, the lock release bar including a lever to pivot the lock lug pivot assembly, wherein the lock release bar is operatively coupled to the first lock.

17. The lift of claim 15, the second support beam comprising a plurality of longitudinally disposed apertures configured to be engagable by the lock projection to lock the lift frame to the second support beam.

18. The lift of claim 15, the second lock including a lock lug stop disposed in the lock housing to limit the pivoting of the lock lug.

19. A lock system for a lift having a single extendable mast, the lock system comprising:

a first stationary support beam disposed adjacent to a first side of the extendable mast, the first stationary support beam including a plurality of longitudinally disposed first apertures;

a second stationary support beam disposed adjacent to a second side of the extendable mast, the second stationary support beam including a plurality of longitudinally disposed second apertures, each second aperture being laterally aligned with a corresponding first aperture;

a lift frame connected to the extendable mast such that the lift frame is movable with respect to the first and second stationary support beams;

a first lock attached to the movable lift frame and including a first lock projection configured to engage any one of the first apertures of the first stationary support beam;

a second lock attached to the movable lift frame and including a second lock projection configured to engage the second aperture corresponding to the first aperture being engaged by the first lock projection;

wherein the first lock projection and the second lock projection are simultaneously operable by a lock control mechanism between one of a plurality of locked positions engaging any one of the first apertures and a corresponding second aperture, respectively, to lock the movable lift frame to the first stationary support beam and the second stationary support beam, and an unlocked position to disengage from the engaged first aperture and the corresponding second aperture, respectively, to unlock the movable lift frame from the first stationary support beam and the second stationary support beam; and a lock control mechanism operatively coupled to the first lock and the second lock to simultaneously operate the first lock and the second lock between any of the plurality of locked positions of the frame and the unlocked position of the frame.

20. The lock system of claim 19, the first lock comprising:

a pair of substantially parallel support plates attached to the frame and being spaced apart to define a lock housing;

a lock lug, the lock lug supporting the first lock projection, the lock lug pivotally disposed in the housing to provide engagement of the first lock projection with the first support beam in the locked position and to disengagement of the first lock projection from the first support beam in the unlocked position; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

21. The lock system of claim 20, the lock control mechanism comprising a lock release bar operatively coupled to the lock lug pivot assembly, the lock release bar including a lever to pivot the lock lug pivot assembly, wherein the lock release bar is operatively coupled to the second lock.

22. The lock system of claim 20, the first lock including a lock lug stop disposed in the lock housing to limit the pivoting of the lock lug.

23. The lock system of claim 19, the second lock comprising:

a pair of substantially parallel support plates attached to the frame and being spaced apart to define a lock housing;

a lock lug, the lock lug supporting the second lock projection, the lock lug pivotally disposed in the housing to provide engagement of the second lock projection with the second support beam in the locked position and disengagement of the second lock projection from the second support beam in the unlocked position; and a lock lug pivot assembly operatively coupled to the lock lug to pivot the lock lug between the locked positions and the unlocked position, the lock lug pivot assembly including a spring operatively coupled to the lock lug to bias the lock lug to the locked position.

24. The lock system of claim 23, the lock control mechanism comprising a lock release bar operatively coupled to the lock lug pivot assembly, the lock release bar including a lever to pivot the lock lug pivot assembly, wherein the lock release bar is operatively coupled to the first lock.

25. The lock system of claim 23, the second lock including a lock lug stop disposed in the lock housing to limit the pivoting of the lock lug.

* * * * *